US008075331B2

(12) United States Patent
Gazelot et al.

(10) Patent No.: US 8,075,331 B2
(45) Date of Patent: Dec. 13, 2011

(54) QUICK LOCK CONNECTOR ASSEMBLY AND A PROCESS FOR COUPLING AND UNCOUPLING SUCH ASSEMBLY

(75) Inventors: Yves Gazelot, Brie-Comte-Robert (FR); Franck Rinaldi, Champigny sur Marne (FR); Jacky Chauveau, Guerard (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 12/577,823

(22) Filed: Oct. 13, 2009

(65) Prior Publication Data

US 2010/0105237 A1 Apr. 29, 2010

(30) Foreign Application Priority Data

Oct. 23, 2008 (FR) ..... 08 05891

(51) Int. Cl.
*H01R 13/627* (2006.01)

(52) U.S. Cl. ..... 439/353

(58) Field of Classification Search ..... 439/353, 439/358, 372, 319, 347, 379, 362
See application file for complete search history.

(56) References Cited

U.S. PATENT DOCUMENTS

| | | | | |
|---|---|---|---|---|
| 5,044,975 | A * | 9/1991 | DiBene et al. | 439/352 |
| 5,123,858 | A * | 6/1992 | Haag et al. | 439/347 |
| 5,401,189 | A | 3/1995 | Sato | |
| 5,775,931 | A * | 7/1998 | Jones | 439/358 |
| 5,818,691 | A | 10/1998 | McMahan | |
| 6,257,913 | B1 * | 7/2001 | Kropa et al. | 439/353 |
| 2008/0014146 | A1 | 6/2008 | Feld et al. | |

FOREIGN PATENT DOCUMENTS

| | | | |
|---|---|---|---|
| DE | 40 13 682 | A1 | 10/1991 |
| DE | 10 2006 057322 | A1 | 6/2008 |
| EP | 0 954 061 | A | 11/1999 |

* cited by examiner

*Primary Examiner* — Alexander Gilman
(74) *Attorney, Agent, or Firm* — Perman & Green, LLP

(57) ABSTRACT

A quick lock connector assembly includes of a first electrical connector or receptacle connector, of a complementary electrical connector or plug, of a system for locking and unlocking connectors forming the connection assembly in order to allow its coupling and uncoupling, in which the receptacle connector and the plug each have at their respective ends a system of integrated sleeves and spring housings actuated by a push force. The disclosed embodiments have a particular application in severe environments.

6 Claims, 2 Drawing Sheets

QUICK LOCK CONNECTOR ASSEMBLY AND A PROCESS FOR COUPLING AND UNCOUPLING SUCH ASSEMBLY

BACKGROUND

1. Field

The aspects of the disclosed embodiments are a quick lock connector assembly for enabling the quick coupling and uncoupling of the elements forming said assembly.

The disclosed embodiments further relates to said process for quick coupling and uncoupling the elements forming said connector assembly.

It is more particularly directed to a connector assembly which contains miniature high-density electrical connectors, each provided with a removable insulative body.

The disclosed embodiments find particular application in severe environments, wherein the components forming the assembly are subjected to big accelerating and centrifugal forces, to vibrations and to shocks, and in general in fields which involve high-speed and high-density data signals processing in very confined spaces.

There is a major need in the aforementioned fields for size reduction of components that have to be integrated into increasingly smaller spaces.

Therefore, components such as high-density rectangular connectors must be dimensioned such as being able to be readily integrated into low-height housings containing electronic systems.

In addition to said need of dimensioning, there is actually a trend towards simplification of the locking and unlocking operations of the connector assembly elements in order to make possible their coupling and uncoupling in increasingly shorter times.

There are numerous embodiments of processes for locking a connector assembly, which generally consist of two rectangular connectors, respectively called receptacle connector and plug connector.

Said two connectors are equipped with electrical or optical contacts, mutually inserted into the insulative body of the receptacle connector and of the plug connector, connected to cables for supplying an electronical device with data signals and/or with power.

The receptacle connector may act as a cable connector, but it is generally fixed on a horizontal or vertical panel. In the case of a panel connection, the contacts are soldered on an electrical board forming part of the electronic circuit.

The receptacle connector has at its both ends a contact-free zone, which enables the introduction of locking means, which are actuated when the complementary mating connector or plug is coupled with the receptacle connector.

These locking means generally consist of two elastic clips folded back on tenons disposed in the contact-free zone at the ends of the plug, or by screws fixed to the ends of the plug and screwed into bores provided at the ends of the receptacle connector.

It is likewise known, for instance from U.S. Pat. No. 5,401,189, that it is possible to use plastic hooks at the ends of a rectangular connector for wiring board, which enable to lock together the elements of the connector assembly. These hooks are brought to the insulative body of a receptacle connector and are provided for locking themselves into an opening in the plug. U.S. Pat. No. 5,401,189 teaches a locking process, but the unlocking of the receptacle connector, namely the release of the receptacle connector hook from the opening of the plug, can only be performed by a special tool.

It is likewise known, for instance from U.S. Pat. No. 5,818,691, that it is possible to use rigid alignment pins working with sliding blocks located on the back side of a portable computer, for docking with a desktop computer.

It was accordingly necessary to develop a locking and unlocking system for a connector assembly, which enables rapid coupling and uncoupling of the elements forming said assembly and without using dedicated tools.

SUMMARY

The disclosed embodiments provide for this purpose a connector assembly consisting of a first electrical connector or receptacle connector, a complementary mating connector or plug and a system consisting of means for locking and unlocking the connectors forming said assembly, in order to enable it to be coupled and uncoupled, the receptacle and the plug having at each of their respective ends a system comprising integrated sleeves and housings means with integrated springs that are actuated by pushing.

According to one of the main characteristics of the disclosed embodiments, the receptacle connector has at both ends a split sleeve fastened to the receptacle and at least two cantilever beams, the opposite free end thereof comprising a hook defining a shoulder.

According to this characteristic of the disclosed embodiments, the beams further comprise a chamfered part arranged on the same generator, but opposite to the shoulder.

According to one of the main characteristics of the disclosed embodiments, the beams are elastic.

According to another main characteristic of the disclosed embodiments, the plug has at both ends a housing containing sliding blocks actuated by a spring, which triggers the travel of a stop plate.

According to yet another main characteristic of the disclosed embodiments, the housing of the sliding blocks also includes a tappet having in its center an internal bore with chamfered edges and actuated by a spring.

The disclosed embodiments further relates to a process for coupling components forming a connector assembly comprised of a first electrical connector or receptacle, a complementary mating electrical connector or plug and a system of means for locking and unlocking connectors forming said assembly, a process according to which the plug housings are located at the ends of the split sleeves of the receptacle and pushed until the shoulders of the beams come into abutment against the stop plate of the sliding blocks.

According to this characteristic of the disclosed embodiments, the shoulders and the surface of the stop plate are kept firmly in contact by the main spring.

The disclosed embodiments likewise concerns a process for uncoupling elements forming a connector assembly comprised of a first electrical connector or receptacle, a complementary mating electrical connector or plug, a system containing means for locking and unlocking the connectors forming said assembly, the process being one wherein the tappet provided in the housings of the plug is pushed until the beam shoulders move away from the stop plate of the sliding blocks.

According to this characteristic of the disclosed embodiments, the push applied by the tappet enables the beams to move away by the action of the chamfered bore located in the center of the tappet on a chamfered section of the beams.

The disclosed embodiments will be better understood with the following description taken in conjunction with the accompanying drawings, wherein

DETAILED DESCRIPTION OF THE DISCLOSED EMBODIMENTS

Figure 1A:
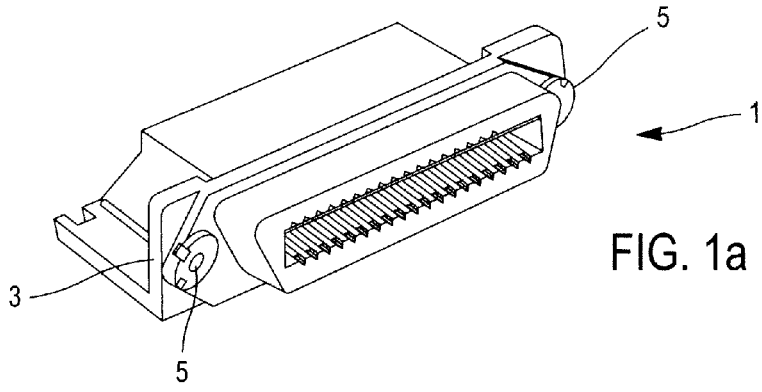
FIGS. 1*a* and 1*b* show perspective views of receptacle connectors according to the prior art.
Figure 1B:
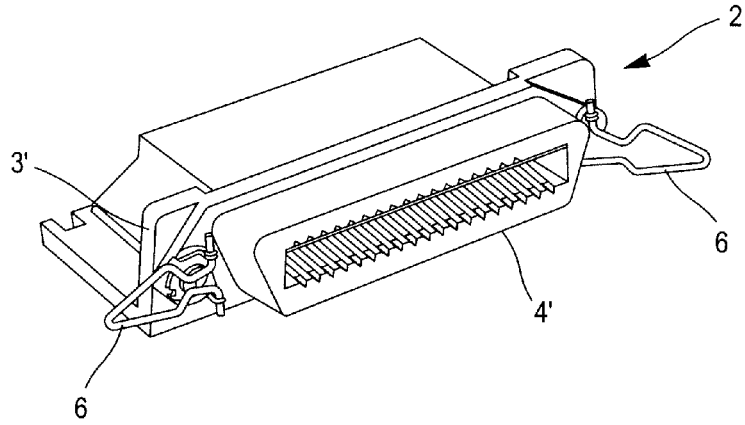

FIGS. 1*a* and 1*b* show receptacle connectors 1 and 2 according to the prior art. These receptacle connectors consist of front plates 3, 3' and central openings 4, 4', in which the electrical or optical contacts are inserted. Generally speaking, these receptacle connectors are fixed on a panel (not shown), or, for example, on a printed circuit board.

Said receptacle connectors represent embodiments of the prior art of the first of two rectangular electrical connectors forming the connector assembly according to the disclosed embodiments and are designed to receive the complementary mating electrical connector of the connector assembly called the plug.

These two connectors are equipped with electrical or optical contacts mutually inserted into the insulative body of the receptacle connector and of the plug and connected to cables (not shown), in order to supply an electronical device with data signals.

On each side of the opening 4, 4' is a contact-free zone, which comprises either a threaded bore 5, or a resilient clip 6, the role thereof having been explained above in the present patent application.

Figure 2:
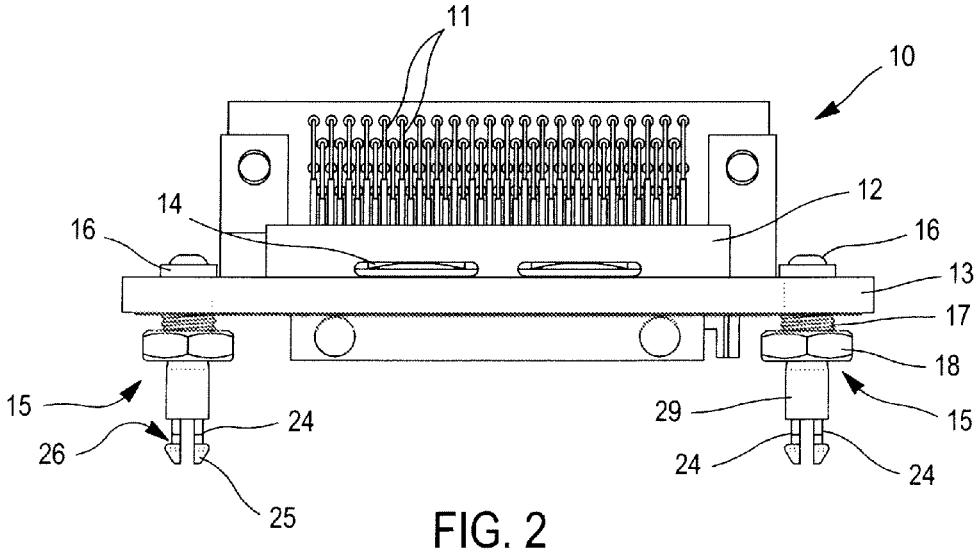
FIG. 2 shows an elevation view of a receptacle connector according to the disclosed embodiments.

FIG. 2 shows an elevation view of a receptacle connector 10 according to the disclosed embodiments. According to the described embodiment, this receptacle connector has elbow-shaped electrical contacts 11, the free ends thereof being soldered on a printed circuit board (not shown).

This receptacle connector consists of a high-density miniature connector comprising a flange 12 that enables an insulative body receiving the electrical contacts 11 to be mounted and retained thereon and receiving a backplane held in the flange by a projecting dimple 14.

The receptacle connector 10 consists of a front plate 13, which receives the flange 12 in its central portion. Split sleeves 15 are arranged in the contact-free zone on each side of the flange 12, the role thereof being described below.

Said split sleeves are fasten on the front plate 13 by a screw 16. They may be fastened by a nut or crimped in place. The screw 16 provides the connection between the plate 13 and a threaded shaft 17 provided with a nut 18, making it possible to secure the receptacle connector on a vertical panel of an electronic system. For example, the space shown between the front plate 13 and the nut 18 is about 2 mm, i.e. the usual thickness of a steel sheet for this type of application. As can be seen from FIG. 4, a sealing joint 19 is located in a groove machined into the lower face of the front plate. When the receptacle connector is fastened to the panel by locking the nut 18, the joint 19 expands into the groove until the plate 13 comes into contact with the panel.

Figure 3:
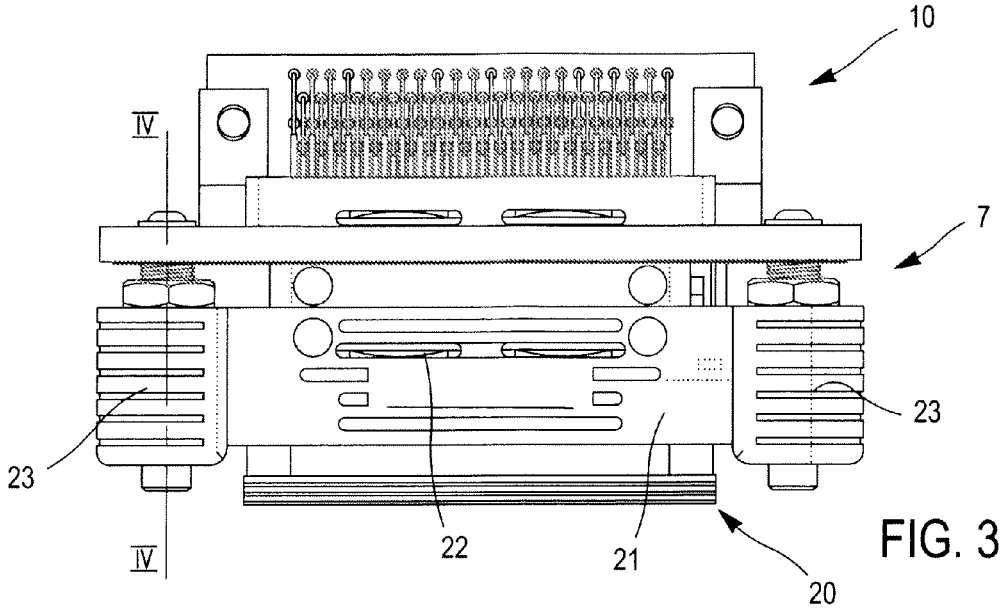
FIG. 3 shows an elevation view of the connector assembly.

FIG. 3 represents a connector assembly 7, wherein the receptacle connector 10 and a complementary mating electrical connector or plug 20 are mated with each other.

According to the described embodiment, the plug 20 consists of a miniature high-density connector, comprising a shell 21 adapted for mounting and retaining an insulative body receiving electrical contacts (not shown) and designed to accommodate a backplane retained by a projecting dimple 22.

Spring housings 23 are arranged in the contact-free zone at each end of the connector housing 21, the role thereof being described below.

Figure 4:
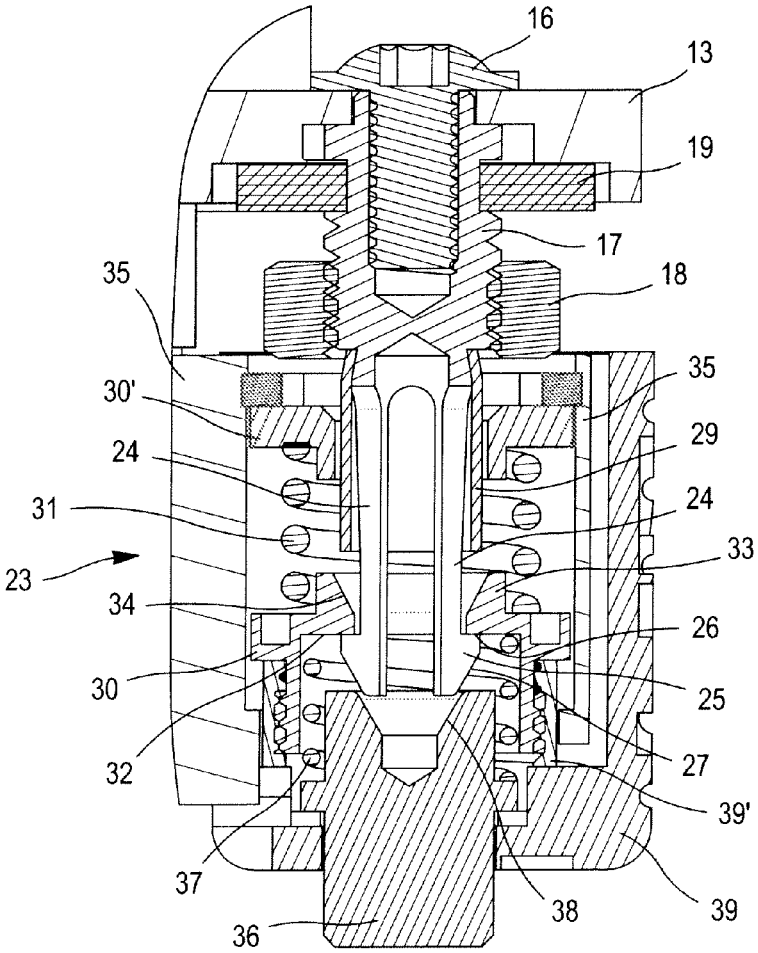
FIG. 4 shows a cross section along the 4-4 axis of FIG. 3.

FIG. 4 shows a cross section along the 4-4 axis of FIG. 3 of the system of split sleeves 15 and integrated spring housings, actuated by pushing into the locked position the connector assembly 7 according to the disclosed embodiments.

As described above, the shaft 17 is machined in its non-threaded section in such a way as to form a hollow sleeve, whose internal surfaces are splitted to form the cantilever beams 24 and whose free ends have hooks 25 defining shoulders 26. There are four of said beams 24 in the example described, but the disclosed embodiments clearly concerns any sleeve which contains at least two beams. The beams 24 additionally contain a chamfered section 27 arranged on the same generator, but opposite to the shoulder 26. The beams 24 are elastic in order to facilitate their quick withdrawal during the coupling and uncoupling of the elements 10, 20 of the connector assembly 7.

In order to protect the integrity of said beams 24 during handling of the elements, a casing 29 is crimped on the shaft 17, which surrounds about two-thirds of the length of the beams 24. Said casing 29 may be produced in such a way as to secure a higher degree of encapsulation of the sleeve in order to protect it more effectively during handling.

In this embodiment, the coupling sequence comprises two stages, i.e. plug-in of the plug 20 into the receptacle connector 10, thereby coming into abutment, followed by interlocking of the connectors in that the two sliding blocks 23 move against the plate 13 until snapping.

The pushing force exerted by the exterior tappet 39 is transmitted to the sliding blocks 30, either via a connecting piece 39', or directly.

The beams in FIG. 4 are in a locked position in a housing 23 comprising sliding blocks 30, 30' actuated by a main spring 31, enabling a stop plate 32 which contains a guide 33 whose central opening 34 is chamfered to travel. This chamfer makes possible the withdrawal of the beams 24 during the locking operation by pushing the chamfered section 27 of the beam 24 against the chamfered surface 34, enabling the beams 24 to be introduced into the guide 33. After the hook 25 passed the end of the guide 33, the shoulders 26 of the beams 24 come into contact with the surface of the stop plate 32 and with the help of the main spring 31, hold the coupling of the elements of the connector assembly 7 firmly together.

The sliding blocks contain a base plate 30', which holds in place the main spring 31 and which is retained in the inner of the housing 23 by a split clip, or by any other means, in a groove machined into the inner wall 35 of the housing 23.

Said housing 23 also has at its end opposite to the end which is in contact with the receptacle connector 10 a tappet 36 actuated by the spring 37. The tappet is internally fitted with a chamfered central bore 38. This tappet is held outside of the housing when the assembly 7 is locked.

When a quick unlocking is necessary, the operative exerts pressure on the tappet 36 whose chamfered section 38 comes into contact with the chamfer 27 of the hooks 25, thus releasing the shoulder 26 from the surface of the stop plate 32, whereby, because of their elasticity, the beams 24 pulled back and the plug 20 can be disconnected from the receptacle connector 10, making possible the rapid uncoupling of the elements of the connector assembly 7.

Among the advantages of the disclosed embodiments which should be noted, there is the fact that the described locking device makes it possible to apply a constant effort to the front faces of the receptacle connector and of the plug when they are coupled together, thus eliminating any risks of residual play between elements. The elimination of residual play makes it possible to ensure very high quality of ground continuity resulting from the contact of the two connector housings.

Similarly, the described system enables the perfect balancing of the locking action at each end of the elements and ensures the exertion of identical pressure on the sealing joint located on the receptacle connector.

The embodiments of the described disclosed embodiments are not limitative and any variants and modifications may be made to the embodiments without departing from the scope or the spirit of the disclosed embodiments.

What is claimed is:

1. A quick lock connector assembly comprising:

a first high-density miniature electrical connector or receptacle connector, a complementary mating high-density miniature connector or plug, a system comprising means for locking and unlocking the connectors, which form said connector assembly, in order to allow its coupling and uncoupling, wherein the receptacle connector has a system of sleeves comprising a split sleeve fastened to the receptacle connector, having at least two cantilever elastic beams, wherein the elastic beams additionally comprise a free end with a hook defining a shoulder, and a chamfered section arranged adjacent to the shoulder;

wherein the plug has a housing comprising sliding blocks actuated by a spring, thereby moving a stop plate; and wherein the receptacle connector and the plug have at each of their respective ends the system of sleeves and the housing.

2. The quick lock connector assembly according to claim 1, wherein the integrated spring housing of the sliding blocks additionally comprises a tappet controlled by a spring and provided in its interior with a chamfered central bore.

3. A process for coupling the elements forming a connector assembly according to claim 1, comprising of a first high-density miniature electrical connector or receptacle connector, a complementary mating high-density miniature electrical connector or plug and a system comprising means for locking and unlocking the connectors forming said assembly, wherein the housings of the plug are located at the ends of the split sleeves of the receptacle connector and pushed until the shoulders of the elastic beams come into abutment against the stop plate of the sliding blocks.

4. The coupling process according to claim 3, wherein the shoulders and the surface of the stop plate are kept firmly in contact by the main spring when the elements are coupled together.

5. A process for uncoupling the elements forming a connector assembly according to claim 1, comprising of a first high-density miniature electrical connector or receptacle connector, a complementary mating high-density miniature electrical connector or plug, a system comprising means for locking and unlocking the connectors forming said assembly, wherein a tappet provided on the housings of the plug is subjected to push forces until the shoulders of the elastic beams move away from the stop plate and the sliding blocks.

6. The uncoupling process according to claim 5, wherein the push force applied by the tappet enables the elastic beams to move away under the action of the central chamfered bore of the tappet on a chamfered section of the elastic beams.

* * * * *